US010837743B1

(12) United States Patent
Beam et al.

(10) Patent No.: US 10,837,743 B1
(45) Date of Patent: Nov. 17, 2020

(54) ARROW HEAD WITH MOVABLE BLADES

(71) Applicant: GSM LLC, Grand Prairie, TX (US)

(72) Inventors: Keith Beam, Waunakee, WI (US); Jason Oman, Henderson, NV (US); Dillon Douglas, Henderson, NV (US)

(73) Assignee: GSM LLC, Grand Prairie, TX (US)

( * ) Notice: Subject to any disclaimer, the term of this patent is extended or adjusted under 35 U.S.C. 154(b) by 0 days.

(21) Appl. No.: 16/565,684

(22) Filed: Sep. 10, 2019

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 4,547,837 A | | 10/1985 | Bennett | |
| 4,998,738 A | | 3/1991 | Puckett | |
| 5,082,292 A | | 1/1992 | Puckett et al. | |
| 5,090,709 A | | 2/1992 | Johnson | |
| 5,102,147 A | | 4/1992 | Szeluga | |
| 5,112,063 A | | 5/1992 | Puckett | |
| 5,286,035 A | | 2/1994 | Ward | |
| 5,564,713 A | * | 10/1996 | Mizek | F42B 6/08 473/583 |
| 5,820,498 A | * | 10/1998 | Maleski | F42B 6/08 473/584 |
| 5,879,252 A | * | 3/1999 | Johnson | F42B 6/08 473/583 |
| 6,171,206 B1 | * | 1/2001 | Liechty, II | F42B 6/08 473/583 |
| 6,287,224 B1 | * | 9/2001 | Liechty, II | F42B 6/08 473/583 |
| 6,398,676 B1 | | 6/2002 | Mizek | |

* cited by examiner

*Primary Examiner* — John A Ricci
(74) *Attorney, Agent, or Firm* — Pauley Erickson & Swanson

(57) ABSTRACT

An arrow head having two different movable blades with at least one blade interchangeably mounted in a pivotal or a fixed position with respect to a blade carrying body and a second blade that moves between a flight position and an impact position. A shaft is used to retain a corresponding blade in a pivotal or a fixed position with respect to a blade carrying body. When the blade is pivotally mounted, a bias force of a retaining member is preferably selected so that each blade remains in a normally closed position during flight of the arrow head and can quickly move to a fully open position upon impact or when a sufficient opening force is applied to the arrow head.

18 Claims, 6 Drawing Sheets

ARROW HEAD WITH MOVABLE BLADES

BACKGROUND OF THE INVENTION

Field of the Invention

This invention relates to an arrow head or a bolt head having two different types of movable blades which can operate as a blade-opening arrow head or bolt head and which has at least one blade which is pivotally mounted to move or operate between a fully open position and a fully closed position and which can maintain both blades in a particular desired position during flight of the arrow head or the bolt head.

Discussion of Related Art

In the archery industry, many manufacturers have attempted to provide an arrow head that has aerodynamic properties similar to those associated with non-bladed arrow heads known as field points or nib points, while simultaneously achieving effective cutting areas provided by bladed arrow heads, which are often referred to as broadheads. Broadhead blades exposed during flight can result in undesirably steering the front portion of the overall arrow or bolt, causing the arrow or bolt to undesirably steer away from a preferred flight path or a target.

By reducing the surface area of a broadhead blade exposed during flight, the undesirable steering effects can be reduced. However, when the surface area of a blade is reduced, the structural integrity can be compromised. Also, when reducing the surface area of a blade, the cutting area within a target material or a game is also reduced, resulting in a less effective game wound.

Many conventional blade-opening arrow heads are designed so that a substantial portion of the blade is hidden within the body of the arrow head, particularly during arrow or bolt flight. Upon impact, many conventional blades are designed to open and thereby expose a cutting surface or sharp edge of the blade. When the blades of such conventional arrow heads are closed and substantially hidden within the body, the exposed surface area is reduced and thus produces relatively less undesirable aerodynamic forces and thus unwanted steering effects.

Many conventional blade-opening arrow heads rely upon complex mechanisms, some of which fail to open because of a significant holding or closing force that must be overcome, and others that open prematurely because of structural deficiencies within the blade carrying body which can cause failure upon impact and result in non-penetration of the arrow. With such relatively complex mechanisms, dirt or other materials that contaminate such conventional arrow heads can also negatively affect the arrow head reliability, particularly after extended use.

Many conventional broadheads which have blades partially hidden within the ferrule body use annular retaining rings, such as O-rings, wraps, bands and the like, in order to maintain the blades in a closed position during flight. Upon impact, such annular retaining rings are designed to sheer or roll back along the opening blades, in order to allow the blades to move to an open position. Quite often, such conventional annular retaining rings crack or become damaged, particularly when the elastomeric material deteriorates. Upon release of a bowstring, the rapid acceleration and thus significant opening forces move the blades in an opening direction. The conventional annular retaining rings counteract such opening forces. However, when the retaining ring material dries out, cracks or is otherwise damaged, blades often open prematurely, resulting in significant danger or injury to the archer.

Many of the annular retaining rings are designed as a consumable for a single use and thus must be replaced after each use. In addition to the cost involved with supplying such consumable item, the annular retaining ring is difficult and time-consuming to install, particularly when in a hunting environment. Also, the material properties of such conventional annular retaining rings can be affected by temperature changes and thus cause different bias forces that open the blade prematurely or not open the blade when desired.

U.S. Pat. No. 5,090,709 teaches an arrow head with extendable blades positioned adjacent fixed blades. The extendable blades are pivotally connected to a body. A ring releasably holds the extendable blades within corresponding slots within the body.

U.S. Pat. No. 5,286,035 teaches an arrow head that has a sharpened blade, pivotally mounted within a slot in the body of the arrow head. A rubber O-ring is used to hold the blade in a temporarily stationary position, centered within the slot in the body. Upon impact, the rubber O-ring slides rearward onto the arrow shaft and allows the blade to pivot to either side of the arrow head body.

U.S. Pat. Nos. 5,112,063, 4,998,738 and 5,082,292 each discloses a broadhead with deployable cutting blades that are connected by pivot pins to a plunger. The cutting blades pivot between an open cutting position and a closed non-barbed position.

U.S. Pat. No. 5,102,147 discloses a ballistic broadhead assembly that has blades pivotally mounted on an actuating plunger. Upon impact, the actuating plunger thrusts the blades outwardly and forwardly.

It is apparent from the conventional blade-opening arrow heads that there is a need for a blade-opening arrow head or bolt head that maintains two different types of blades in a closed and frictionally locked position during flight, and that allows the blades to quickly move to an open position when a sufficient opening force is applied to the blade. It is apparent that there is a need for a blade-opening arrow head that does not require consumable items, such as O-rings, wraps, bands and the like, to hold the blades in a closed position. It is also apparent that there is a need for an arrow head that will accommodate different types of movably mounted blades.

SUMMARY OF THE INVENTION

It is one object of this invention to provide an arrow head with two different types of blades each movably attached directly to or with respect to a blade carrying body. One type of blade has a portion of one blade movably mounted within one slot of the blade carrying body between a retracted position and an expanded position. Another type of blade as a portion of another blade movably mounted within another slot of the blade carrying body between a flight position and an impact position.

In some embodiments of this invention, at least 2 rearward blades are pivotally mounted with respect to the blade carrying body and at least one forward blade is pivotally mounted with respect to the blade carrying body. According to some embodiments of this invention, at least a portion of the rearward blades is mounted within or hidden within the one slot and at least a portion of each forward blade is mounted within or hidden within the other slot.

In some embodiments of this invention, the forward blade is maintained in a flight position during flight of the arrow head or the bolt head. The forward blade can pivot between a forwardmost right position and a forwardmost left position, particularly as the arrow head penetrates a target material. As the arrow head penetrates the target material, in some embodiments of this invention, each rearward blade moves from a retracted position to an expanded position, for example, to expose a sharpened edge of each rearward blade and cut the target material.

In some embodiments of this invention, the pivotally mounted blades can be maintained in a normally retracted position or a normally flight position, wherein a significant portion of each blade is housed within a corresponding slot of the blade carrying body, and the rearward blades can move into the expanded position upon target impact or upon experiencing a similar opening force directed to the arrow head.

In some embodiments of this invention, the blade-opening arrow head uses different types of bias elements, springs and/or engaging elements that can be used to maintain pivotally mounted blades in their respective normally closed positions but which also provides bias forces that can be overcome by an opening force applied to the blade.

In some embodiments of this invention, the movable blades operate without a need for consumable mechanical components, such as O-rings, bands, wraps and the like, which are conventionally used to maintain opening blades in a closed position during flight.

In some embodiments, a spring element according to this invention requires no consumable element to maintain the pivotal blades in a normally closed position. Eliminating such conventional consumable elements can improve the safety aspects of the arrow head of this invention, and can significantly reduce the cost for using the arrow head by eliminating the need for a user to purchase consumable goods and attempting to install such conventional consumable elements, particularly during a time-critical hunt.

BRIEF DESCRIPTION OF THE DRAWINGS

The above-mentioned and other features and objects of this invention will be better understood from the following detailed description taken in conjunction with the drawings, wherein.

DESCRIPTION OF PREFERRED EMBODIMENTS

Figure 1:
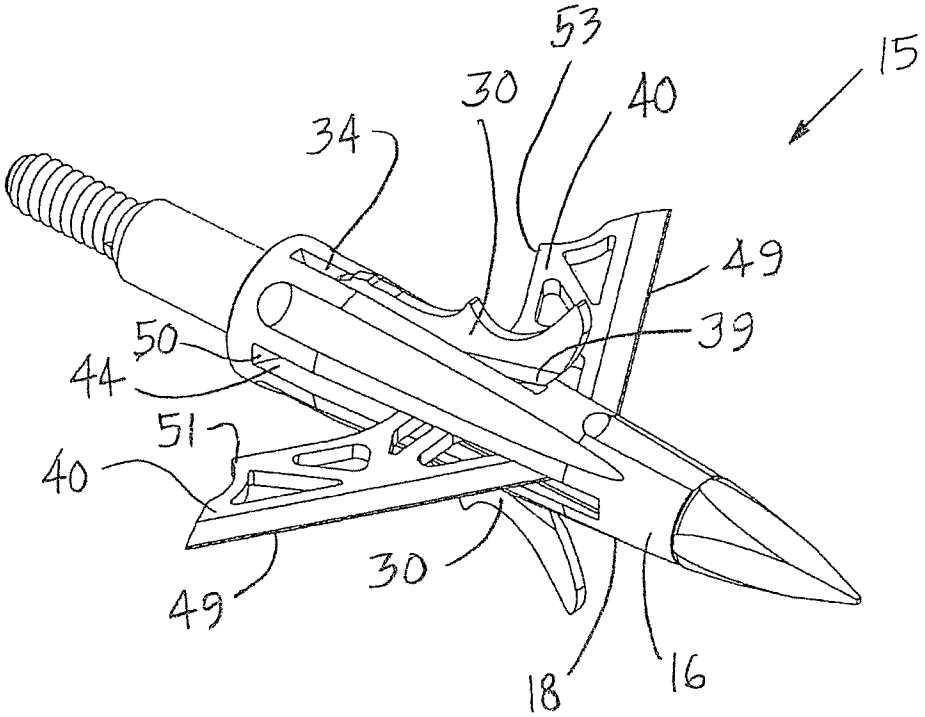
FIG. 1 is a perspective front view of arrow head with movable blades, with at least one blade in a retracted position and another blade in a flight position, according to one embodiment of this invention.

FIGS. 1-5 and FIGS. 6-11 show two different embodiments of arrow head or bolt head 15, according to this invention. As used throughout this specification and in the claims, the term arrow head and bolt head are intended to be interchangeable with each other and relate to a mechanical or structural head or head device that is attached, connected and/or otherwise secured directly or indirectly with respect to an arrow shaft used with archery bows and/or to a crossbow bolt shaft used with crossbows.

According to each of the two different embodiments, arrow head 15 or bolt head 15 comprises at least one blade 30 and at least one blade 40 mounted, attached and/or otherwise secured directly to or with respect to blade carrying body 16 of arrow head 15. As shown in FIGS. 1-11, arrow head 15 has 2 blades 30 and one blade 40. In other embodiments of this invention, arrow head 15 has either one or more than 2 blades 30. In other embodiments of this invention, arrow head 15 has 2 or more blades 40.

Figure 6:
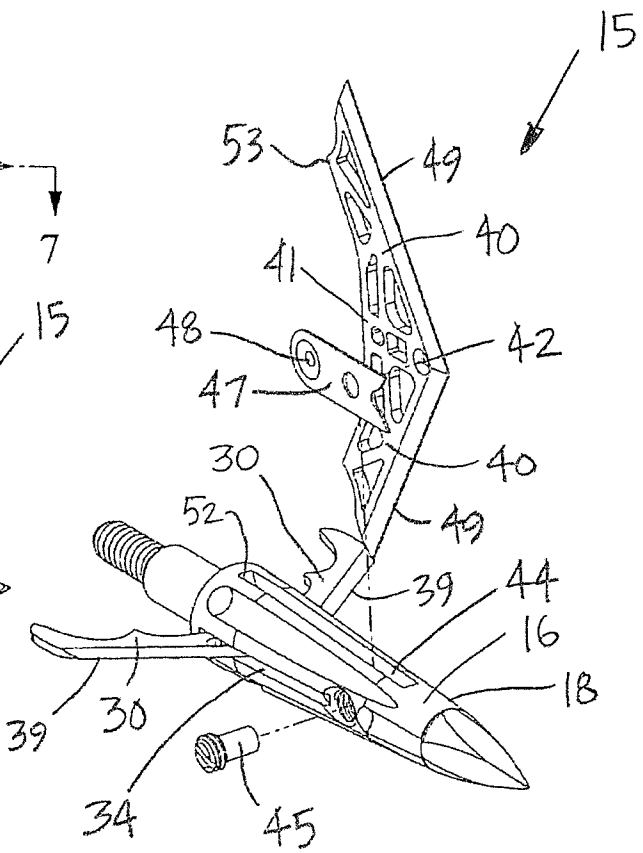
FIG. 6 is an exploded perspective front view of arrow head with movable blades, according to one embodiment of this invention.
Figure 8:
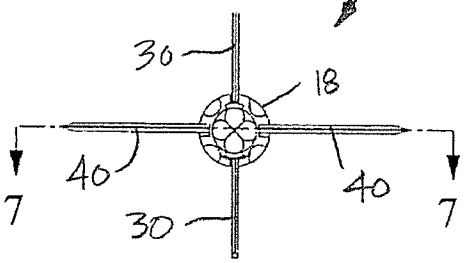
FIG. 8 is a front view of the arrow head as shown in FIG. 6.

A desired weight and/or overall size of arrow head 15 according to this invention can be used to determine the number of blades 30 and the number of blades 40. When a plurality of blades 30 and/or 40 are used, the blades 30 and/or 40 can be preferably arranged and/or positioned so that they evenly balance arrow head 15. For example, as shown in FIGS. 1 and 6, both blades 30 are spaced at generally equal circumferential locations about body 16. For aerodynamic reasons, it is desirable for arrow head 15 to be balanced along or about a centerline axis of body 16.

Figure 5:
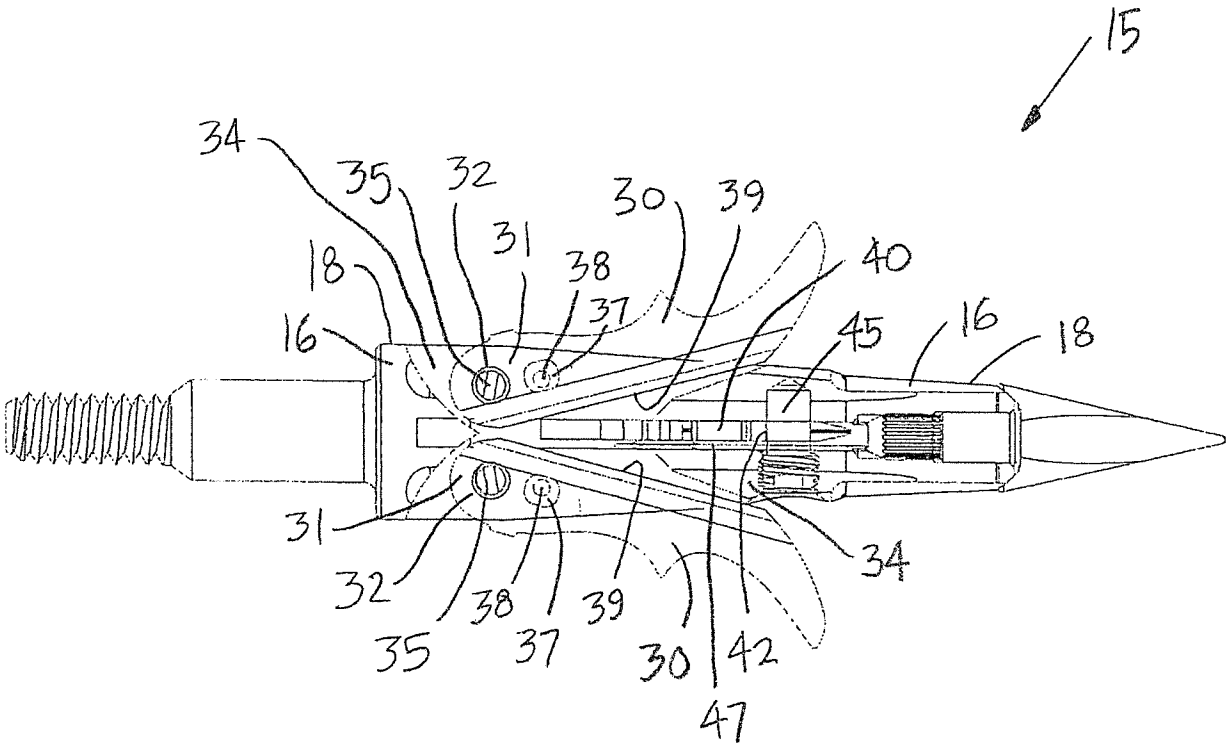
FIG. 5 is a side sectional view of the arrowhead as shown in FIG. 1, with all of the blades in the position as shown in FIG. 1.

In some embodiments of this invention, such as shown in FIG. 5, portion 31 of blade 30 is mounted within slot 34 formed of or within body 16, and blade 30 is movably mounted between a retracted position and an expanded position of blade 30. According to some embodiments of this invention, shaft 35 is secured, attached and/or otherwise connected directly to or with respect to body 16. In some embodiments of this invention, blade 30 has or forms bore 32 and shaft 35 is movably mounted within bore 32.

Figure 3:
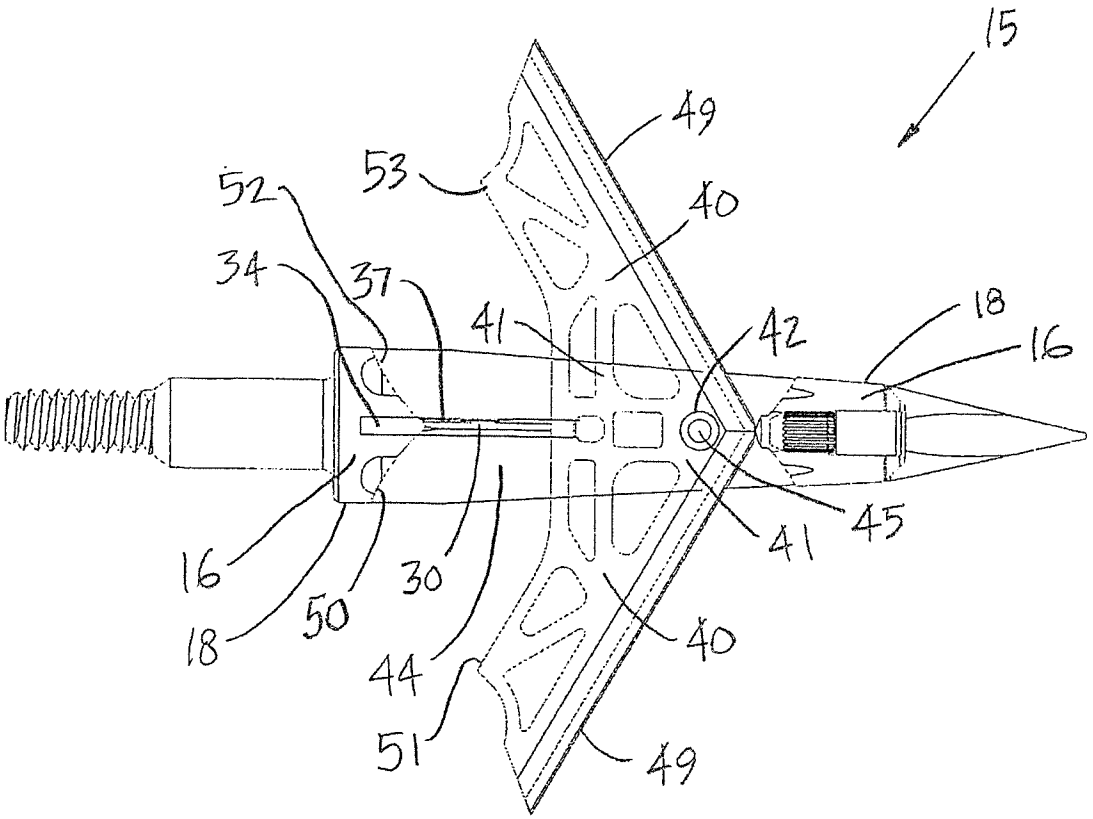
FIG. 3 is a top sectional view of the arrowhead as shown in FIG. 1, with all of the blades in the position as shown in FIG. 1.

According to some embodiments of this invention, such as shown in FIG. 3, portion 41 of blade 40 is mounted within slot 44 of or within body 16, and blade 40 is movably mounted between a flight position and an impact position of blade 40. According to some embodiments of this invention, shaft 45 is secured, attached and/or otherwise connected directly to or with respect to body 16. In some embodiments of this invention, blade 40 has or forms bore 42 and shaft 45 is movably mounted within bore 42.

Figure 9:
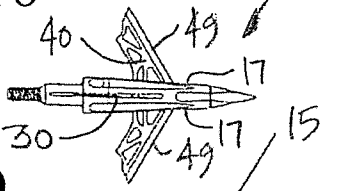
FIG. 9 is a top view of a multi-blade arrow head with a forward blade in a flight position, according to one embodiment of this invention.

In some embodiments of this invention, blade 40 is maintained or kept in the flight position during a flight of arrow head 15. For example, FIG. 9 shows one embodiment of a position of blade 40 during a flight of arrow head 15 which can be considered a standby position, a locked position and/or an in-flight position, of arrow head 15, particularly in which blade 40 has a relatively aligned and/or straight position with respect to body 16 and/or a longitudinal axis or a centerline axis of body 15. As shown between FIGS. 10 and 11, blade 40 can rotate, translate and/or swing to the left or to the right, depending upon which direction impact forces resulting from impact with a target material causes blade 40 to move left or right from the in-flight position. In some embodiments of this invention, as blade 40 penetrates and moves through a target material, such as a game animal body, different frictional forces caused by bones and/or other body or target material can cause blade 40 to rotate, translate and/or swing left-to-right or right-to-left, depending upon resistance from the different frictional forces.

As shown in FIGS. 3 and 6, for example, blade 40 is pivotable, such as from left to right or from right to left, between contact area 50 of body 16 and contact area of 52 of body 16. In some embodiments of this invention, blade part 51 of blade 40 makes or forms contact with body 16 and/or blade part 53 of blade 40 makes or forms contact with body 16, particularly one contact as blade 40 moves to the extreme left-to-right position and another contact as blade 40 moves to the extreme right-to-left position, for example, as shown between FIGS. 10 and 11. In some embodiments of this invention, blade 40 can move from right to left or from left to right without fully reaching and making contact with contact area 50 and/or contact area 52 of body 16.

Figure 2:
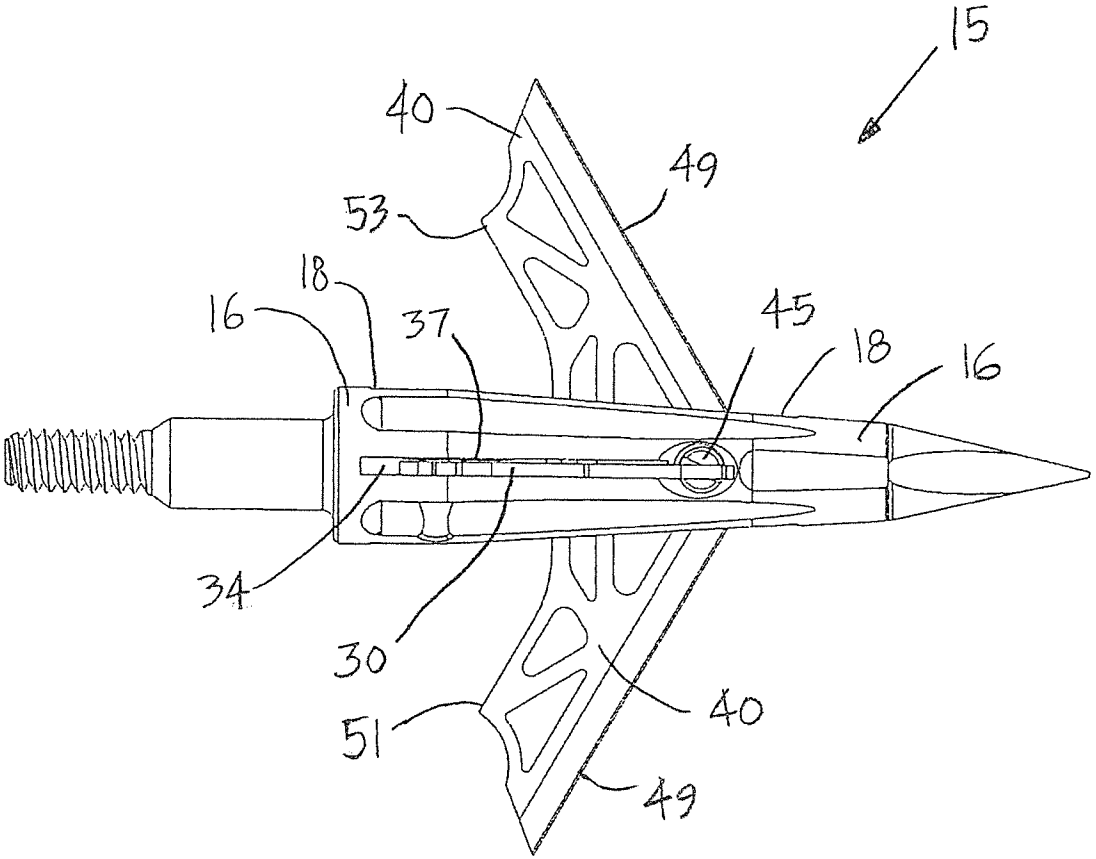
FIG. 2 is a top view of the arrowhead as shown in FIG. 1, with all of the blades in the position as shown in FIG. 1.

In some embodiments of this invention, such as shown in FIGS. 1-7, blade 30 comprises leading edge 39. In some embodiments of this invention, leading edge 39 extends beyond outer surface 18 of body 16. In some embodiments of this invention, blade 40 comprises at least one leading edge 49. As shown in FIGS. 1-7, leading edge 49 can be positioned and/or arranged on opposing sections of blade 40. As shown in FIGS. 1-3, for example, both leading edges 49 can form an acute angle or an obtuse angle with respect to each other and/or with respect to a centerline of body 16. In some embodiments of this invention, leading edges 49 can each extend beyond outer surface 18 of body 16.

Figure 7:
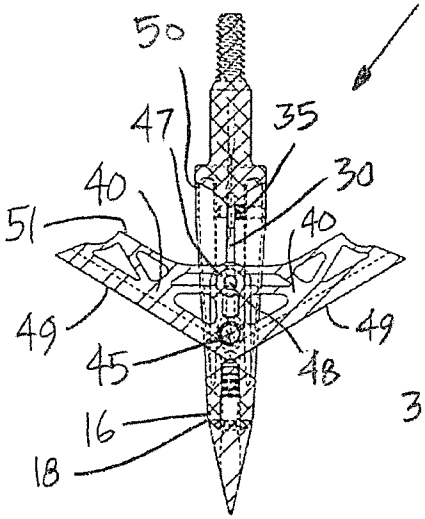
FIG. 7 is a top sectional view of the arrow head taken along line 7-7, as shown in FIG. 6.

In some embodiments according to this invention, such as shown FIGS. 5-7, bias element 37 is positioned and/or mounted between blade 30 and body 16. In some embodiments of this invention, bias element 37 forms contact between or makes contact with blade 30 and/or body 16. As shown in FIGS. 5 and 6, bias element 37 has detent 38 engageable with blade 30, for example, to maintain blade 30 in the retracted position during the flight of arrow head 15. In some embodiments of this invention, blade 30 pivots about shaft 35, for example, between the retracted position and the expanded position. In some embodiments of this invention, bias element 37 can be sized, shaped and/or otherwise designed to cause enough friction to prevent blade 30 from moving from the retracted position to the expanded position during flight of arrow head 15. In other embodiments of this invention, bias element 37 can be sized, shaped and/or otherwise designed to allow blade 32 to move from the retracted position to the expanded position, particularly upon or when receiving a force great enough to move blade 30 from the retracted position to the expanded position.

In some embodiments according to this invention, such as shown in FIGS. 3-7, bias element 47 is positioned and/or mounted between blade 40 and body 16. In some embodiments of this invention, bias element 47 forms contact between or makes contact with blade 40 and/or body 16. As shown in FIGS. 3 and 6, bias element 47 has detent 48 engageable with blade 40, for example, to maintain blade 40 in the flight position during the flight of arrow head 15. In some embodiments of this invention, blade 40 pivots about shaft 45, for example, between the flight position and the impact position. In some embodiments of this invention, bias element 47 and/or detent 48 can be sized, shaped and/or otherwise designed to cause enough friction to prevent blade 40 from moving from the flight position to the impact position, particularly during flight of arrow head 15. In other embodiments of this invention, bias element 47 and/or detent 48 can be sized, shaped and/or otherwise designed to allow blade 40 to move from the flight position to the impact position upon or when receiving a force great enough to move blade 40 from the flight position to the impact position.

In some embodiments according to this invention, shaft 35 and/or shaft 45 each is mounted with respect to body 16. Each blade 30 and 40 preferably has a through hole or a blind bore 32 and 42 within which shaft 35 or shaft 45, respectively, is mateably mounted. By forming a relatively tight clearance between blade 30 or 40 and shaft 35 or 45, blade 30 or 40 can easily rotate or otherwise move about shaft 35 or 45, without significant wobbling of blade 30 or 40. Contact surfaces between shaft 35 or 45 and blade 30 or 40 can be machined or finished to provide a relatively tight tolerance with relatively minimal friction and thus allow blade 30 or 40 to easily pivot or otherwise move with respect to body 16, which can allow easy opening of blade 30 or 40, particularly when arrow head 15 impacts a target or when a sufficient opening force is applied to blade 30 or 40.

In some embodiments of this invention, as arrow head 15 contacts or impacts a target, the target material or surface preferably impinges upon or makes contact with a forward portion or a tip portion of blade 40 and thereby provides the necessary force for operating, pivoting, rotating and/or otherwise moving blade 40 from the flight position to the impact position and/or between the flight position and the impact position. The force can be applied to any part of blade 40 in any suitable direction. FIGS. 1-11 show embodiments of blade 40 that are particularly suitable for ensuring that blade 40 operates, pivots, rotates and/or otherwise moves to or in a direction towards the impact position upon target impact. In the flight position of blade 40, the forwardmost portion of blade 40 is preferably but not necessarily sharp and/or otherwise capable of cutting the target material, such as shown in FIGS. 1-11, and thus provides a cutting or puncturing surface upon blade-to-target impact.

Figure 4:
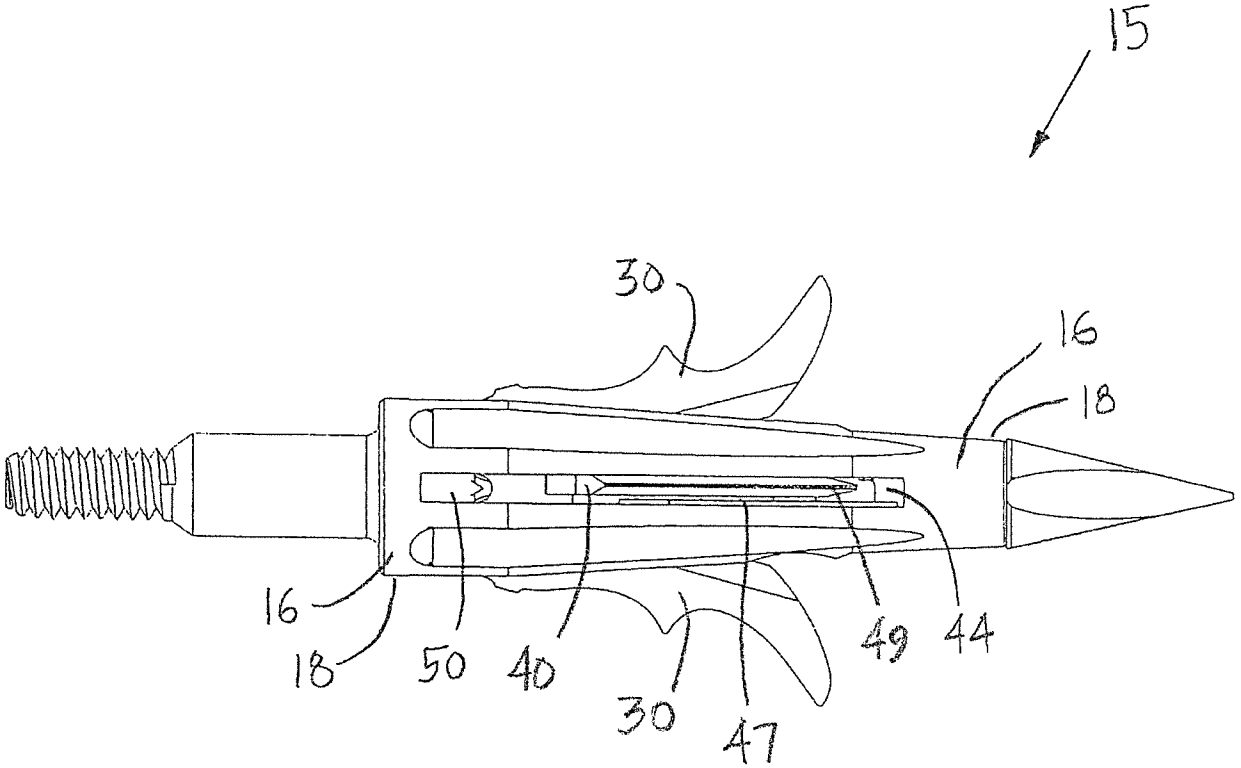
FIG. 4 is a side view of the arrowhead as shown in FIG. 1, with all of the blades in the position as shown in FIG. 1.

In some embodiments of this invention, as arrow head 15 contacts or impacts a target, the target material or surface preferably impinges upon or makes contact with a tip portion of blade 30 and thereby provides the necessary opening force for operating, pivoting, rotating and/or otherwise moving blade 30 from the retracted position to the expanded position. FIGS. 1-8 show embodiments of blade 30 that are particularly suitable for ensuring that blade 30 operates, pivots, rotates and/or otherwise moves to the retracted position upon target impact. In the retracted position of blade 30, the forwardmost portion of blade 30 is preferably but not necessarily rounded and blunt, such as shown in FIGS. 4 and 5, and thus provides a bearing surface rather than a cutting or puncturing surface upon blade-to-target impact. The opening force can be applied to blade 30 in any suitable direction.

Figure 10:
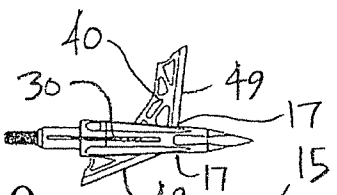
FIG. 10 is a top view of the multi-blade arrow head as shown in FIG. 9, but with the forward blade rotated to a first forwardmost position.
Figure 11:
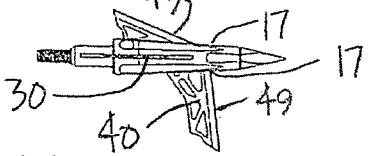
FIG. 11 is a top view of the multi-blade arrow head as shown in FIG. 9, but with the forward blade rotated to a second forwardmost position.

FIGS. 9-11 show how blade 40 moves between the flight position shown in FIGS. 7 and 9 and one impact position shown in FIG. 10 and another impact position shown in FIG. 11. In some embodiments of this invention, blade 40 moves from the flight position towards and travels an entire distance to one or the other impact position of blade 40 and blade 40 makes contact with, stops movement at and/or abuts with one of stop surfaces 17, such as shown in FIGS.

9-11, of body 16. In some embodiments of this invention, blade 40 moves from the flight position towards but does not travel the entire distance to and thus stops short of one or the other impact position of blade 40. In some embodiments, as arrow head 15 moves through a target material, such as an animal body or a target structure, blade 40 is free to operate, pivot, rotate and/or otherwise move away from the flight position and as blade 40 moves and encounters structural irregularities, such as animal bones and/or muscles, blade 40 can operate, pivot, rotate and/or otherwise move in any direction to help or accommodate arrow head 15 to pass through the target material.

In some embodiments of this invention, shaft 35 and/or shaft 45 has a generally circular cross section. However, it is apparent that shaft 35 and/or shaft 45 can have any other suitable cross section which can be used to pivotally mount blade 30 or 40 with respect to body 16. A generally circular cross section of shaft 35 and/or shaft 45 can provide increased bearing surface area between blade 30 or 40 and shaft 35 or shaft 45 and thus can prevent blade instability, such as blade wobble.

Although shaft 35 and/or shaft 45 each is preferably mounted within body 16 so that no portion of shaft 35 and/or shaft 45 extends beyond outer surface 18 of body 16, at least a portion of shaft 35 and/or shaft 45 could extend beyond outer surface 18 of body 16. Shaft 35 and/or shaft 45 can be mounted within body 16 so that shaft 35 and/or shaft 45 is either fixed or movable with respect to body 16.

Bias element 37 and/or bias element 47 of this invention can comprise leaf springs, coil springs and/or any other suitable force member that has a return force or a bias force. For example, bias element 37 and/or bias element 47 may comprise a shape-memory material that returns to its initial shape after being bent, compressed or otherwise deformed.

As used throughout the specification and in the claims, the word rounded is intended to relate to a tip portion of blade 30 and or blade 40 having no sharp points. One advantage of the rounded tip portion is to provide a bearing surface which contacts and slides with respect to a target surface, rather than puncturing or cutting the target surface.

In different embodiments of this invention, components of arrow head 15 according to this invention can be constructed of relatively high-strength materials, such as lightweight metals, graphites, graphite composites and other suitable materials known to those skilled in the art. Although certain components shown in the drawings may be identified as metal, plastic or composite, it is apparent that various materials can be interchanged without departing from the desired results of arrow head 15 according to this invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. An apparatus for mounting a first blade and a second blade within a blade carrying body of an arrow head or a bolt head, the apparatus comprising:

a first portion of the first blade mounted within a first slot of the blade carrying body, the first blade movable between a retracted position and an expanded position, a first shaft secured with respect to the blade carrying body, the first blade having a first bore, the first shaft movably mounted within the first bore; and a second portion of the second blade mounted within a second slot of the blade carrying body, the second blade movable between a flight position and an impact position, a second shaft secured with respect to the blade carrying body, the second blade having a second bore, the second shaft movably mounted within the second bore, the second blade maintained in the flight position during a flight of the arrow head or the bolt head, and the second blade comprising opposing sharpened leading edges.

2. The apparatus according to claim 1, wherein a first bias element is positioned between and makes contact with the first blade and the blade carrying body.

3. The apparatus according to claim 2, wherein the first bias element has a first detent engageable with the first blade to maintain the first blade in the retracted position during the flight of the arrow head or the bolt head.

4. The apparatus according to claim 1, wherein the first blade pivots about the first shaft between the retracted position and the expanded position.

5. The apparatus according to claim 1, wherein a second bias element is positioned between and makes contact with the second blade and the blade carrying body.

6. The apparatus according to claim 5, wherein the second bias element has a second detent engageable with the second blade to maintain the second blade in the flight position during the flight of the arrow head or the bolt head.

7. The apparatus according to claim 1, wherein the second blade is pivotable between a first contact area at which a first blade part of the second blade contacts the blade carrying body and a second contact area at which a second blade part of the second blade contacts the blade carrying body.

8. The apparatus according to claim 1, wherein the first blade comprises a leading edge extending beyond an outer surface of the blade carrying body.

9. The apparatus according to claim 8, wherein the leading edge is blunt.

10. An apparatus for mounting blades within a blade carrying body of a head of an arrow or a bolt, the apparatus comprising:

a first blade of the blades mounted within a first slot of the blade carrying body, the first blade movable between a retracted position and an expanded position, a first shaft secured with respect to the blade carrying body, the first blade having a first bore, the first shaft movably mounted within the first bore; and a second blade of the blades mounted within a second slot of the blade carrying body, the second blade movable between a flight position and an impact position, a second shaft secured with respect to the blade carrying body, the second blade having a second bore, the second shaft movably mounted within the second bore, a bias element positioned between and contacting the second blade and the blade carrying body, and the second blade having a sharpened leading edge.

11. The apparatus according to claim 10, wherein a second bias element is positioned between and makes contact with the first blade and the blade carrying body.

12. The apparatus according to claim 11, wherein the second bias element has a detent engageable with the first blade to maintain the first blade in the retracted position during the flight of the arrow head or the bolt head.

13. The apparatus according to claim 10 wherein the first blade pivots about the first shaft between the retracted position and the expanded position.

14. A method for mounting a first blade and a second blade within a blade carrying body of an arrow head or a bolt head, the method including:

mounting a first portion of the first blade within a first slot of the blade carrying body;

moving the first blade between a retracted position and an expanded position;

securing a first shaft with respect to the blade carrying body;

movably mounting the first shaft within a first bore of the first blade;

mounting a second portion of the second blade within a second slot of the blade carrying body wherein the second blade comprises opposing sharpened leading edges;

moving the second blade between a flight position and an impact position;

securing a second shaft with respect to the blade carrying body;

movably mounting the second shaft within a second bore of the second blade; and maintaining the second blade in the flight position during a flight of the arrow head or the bolt head.

15. The method according to claim 14, wherein a first bias element is positioned between and contacts the first blade and the blade carrying body.

16. The method according to claim 15, wherein the first bias element has a first detent engageable with the first blade to maintain the first blade in the retracted position during the flight of the arrow head or the bolt head.

17. The method according to claim 14 wherein the first blade pivots about the first shaft between the retracted position and the expanded position.

18. The method according to claim 14, wherein a second bias element is positioned between and contacts the second blade and the blade carrying body.

* * * * *